US006180234B1

(12) United States Patent
Hashemzadeh

(10) Patent No.: US 6,180,234 B1
(45) Date of Patent: Jan. 30, 2001

(54) CELLULOSE FIBERS AND YARNS WITH A REDUCED TENDENCY TO FORM FIBRILS

(75) Inventor: Abdulmajid Hashemzadeh, Elsenfeld (DE)

(73) Assignee: Akzo Nobel, N.V., Arnhem (NL)

( * ) Notice: Under 35 U.S.C. 154(b), the term of this patent shall be extended for 0 days.

(21) Appl. No.: 09/292,826

(22) Filed: Apr. 16, 1999

Related U.S. Application Data

(62) Division of application No. 08/860,220, filed as application No. PCT/EP95/05109 on Dec. 22, 1995, now Pat. No. 6,048,479.

(30) Foreign Application Priority Data

Dec. 23, 1994 (DE) ..... 44 46 307

(51) Int. Cl.[7] ..... B32B 23/00
(52) U.S. Cl. ..... 428/393; 428/375
(58) Field of Search ..... 428/375, 393

(56) References Cited

U.S. PATENT DOCUMENTS

| | | |
|---|---|---|
| 3,952,134 | 4/1976 | Watson . |
| 4,128,675 | 12/1978 | Rossler et al. . |
| 5,520,869 | 5/1996 | Taylor . |
| 5,593,483 | 1/1997 | Brunken . |

FOREIGN PATENT DOCUMENTS

| | | |
|---|---|---|
| 65709y/37 | 1/1976 | (JP) . |
| WO 92/07124 | 4/1992 | (WO) . |
| WO 94/20656 | 3/1994 | (WO) . |

OTHER PUBLICATIONS

Dannhorn, Bernd. "Der Einfluss der Ausrüstung mit Vernetzern und Additiven bei Artikeln aus Lyocellfasern," *Lenzinger Berichte*, No. 9, Sep. 1994, Lenzing, Austria, pp. 73–80.

Welch, Clark. "High Speed Crosslinking: Durable Press Finishing Without Formaldehyde," *Textile Chemist and Colorist*, vol. 22, No. 5, May 1990, pp. 13–16.

Sello, Stephen. "Functional Finishes for Natural and Synthetic Fibers," *Journal of Applied Polymer Science*, Applied Polymer Symposium 31 (1977), pp. 229–249.

Mark, H, Norman S. Wooding and Sheldon M. Atlas. *Chemical Aftertreatment of Textiles*, (1971), Chapter V: "In Situ Formation of Polymers".

Lewin, Menachem and Stephen B. Sello. *Handbook of Fiber Science and Technology: vol. II: Chemical Processing of Fibers and Fabrics: Functional Finishes Part B*, Chapters 1 and 2.

*Textilveredelung 20*, No. 1 (1985), pp. 8–12.

"Textil und Silikone, Weichmacher und Elastomere," Wacker Chemie GmbH Brochure, (No. 4696.3/93(8)) 90, pages 10 and 14.

*Primary Examiner*—William Krynski
*Assistant Examiner*—J. M. Gray
(74) *Attorney, Agent, or Firm*—Oliff & Berridge, PLC

(57) ABSTRACT

A process for manufacturing cellulose fibers or yarns with a reduced tendency to form fibrils includes treating fibers or yarns, which are washed after the filament forming process but not yet dried, with a cross-linking agent. The process includes treating the fibers or yarns with reactive polysiloxanes which are modified with amino, polyalkylene oxide, epoxy or carboxyl functional groups and which cross-link with themselves. The process is particularly suitable for fibers produced according to the NMMO process.

8 Claims, 1 Drawing Sheet

CELLULOSE FIBERS AND YARNS WITH A REDUCED TENDENCY TO FORM FIBRILS

RELATED APPLICATION

This is a divisional of application Ser. No. 08/860,220, filed Jul. 1, 1997, now U.S. Pat. No. 6,048,479, which in turn was the U.S. national Stage application of International Application No. PCT/EP 95/05109 filed Dec. 22, 1995.

BACKGROUND OF THE INVENTION

The invention relates to cellulose fibers or yarns with a reduced tendency to form fibrils and a process for manufacturing such fibers or yarns, whereby the fibers are preferably produced according to the NMMO filament formation process.

Cellulose fibers and yarns have long been known. The most important classic production processes are the so-called cuprammonium process and the viscose process.

It has also long been known how to dissolve cellulose polymers in an amine oxide of a tertiary amine, if necessary in the presence of water, and to produce from these solutions, by means of pressing through nozzle tools, formed objects such as fibers, filaments, yarns, films, and the like. Processes using N-methylmorpholine-N-oxide have turned out to be particularly suitable; economical interests and development efforts are centered on those processes. Processes for the production of such formed objects using N-methylmorpholine-N-oxide, in the following called NMMO processes, essentially consist in that, first, a suspension is produced from cellulose such as cotton linters, chemical wood pulp and the like, water and NMMO and in that this suspension is transformed into a solution by heating and removing a portion of the water.

This solution is then filtered and extruded through a nozzle into a mostly aqueous coagulation bath, preferably with an interim air gap, whereby the formed objects such as filaments, yarns, films and the like are formed via coagulation. These formed objects are then washed to remove any tertiary amine oxide still present. Subsequently the formed object can be dried and further processed in the customary manner, e.g. wound up, etc.

Compared to the classic processes for manufacturing cellulose formed objects, the NMMO process is in particular characterized in that it involves essentially physical phenomena, so that at least in theory no chemical reactions take place and no chemical byproducts are formed which must be disposed of as waste products or transformed back by chemical methods into the initial substances. The NMMO process therefore fundamentally ranks among the very environmentally friendly processes. Additionally the actual initial substance is a raw material which grows back, and the cellulose final product is highly biodegradable.

However, it has been shown that the cellulose fibers, especially those which are produced according to the NMMO process, exhibit a tendency to form fibrils, in particular in a wet state, especially if mechanical forces act on the fibers. This happens in the case of dyeing, among others, as well as during washing of the fibers, when after leaving the coagulation bath the solvent still present on the fibers is to be removed. Naturally, in all further processing steps the existing fibrils will be more or less conspicuous, in the dried state as well.

Dust is increasingly formed, and fine fibrils break off and roll together in curl fashion. Entire fibrils may even break off.

It may be true that the formation of fibrils can be useful in creating special surface effects, but for most applications fibrils are not desired.

Efforts have been undertaken to counteract the disadvantages of fibril formation in that e.g. dyed fabrics are treated with commercial cellulose cross-linking agents which have low formaldehyde content. By doing so the formation of fibrils in the fabric is reduced, although the rougher texture that the fabric exhibits must be tolerated.

Besides other disadvantages, a corresponding cross-linking prior to dyeing has the consequence that the dye receptivity is considerably reduced.

One further process for reducing the formation of fibrils is described in the international patent application WO 92-07124. This process consists essentially in that the cellulose fibers, which are not yet dried, are treated with an aqueous solution or dispersion of a polymer possessing a plurality of cationic groups. Since these polymers can be washed out very easily, it is recommended to also use a cross-linking agent, especially together with a catalyst. This process likewise diminishes the dye receptivity, and the elongation of the fibers is reduced.

Even though numerous methods are known to reduce the formation of fibrils in cellulose fibers, there is still a need for improved fibers and yarns with reduced fibril formation, as well as for improved and economically viable processes for manufacturing such fibers.

Therefore the objective of the present invention is to provide cellulose fibers and yarns, in particular such cellulose fibers and yarns which were obtained according to the NMMO process, which exhibit a reduced tendency to form fibrils, but which at the same time have a very good dye receptivity, i.e., a dye receptivity which essentially corresponds to that of untreated fibers or a dye receptivity which is only negligibly reduced, and whose mechanical textile properties, especially the elongation, are not or only negligibly affected compared to untreated fibers. A further objective of the invention is to provide a corresponding process by which such fibers are accessible, a process which operates economically, is conducive to reproducible results, operates continuously, allows a high spinning speed and does not require subsequent cleaning or neutralization steps in this connection.

SUMMARY OF THE INVENTION

This objective is met by a process for manufacturing cellulose fibers or yarns with a reduced tendency for forming fibrils by treating, after the filament forming process, the washed but not yet dried fibers or yarns with a cross-linking agent, characterized in that fibers or yarns are treated with reactive polysiloxanes which are modified with amino, polyalkylene oxide, epoxy or carboxyl functional groups and which cross-link with themselves.

DETAILED DESCRIPTION OF PREFERRED EMBODIMENTS

Figure 1:
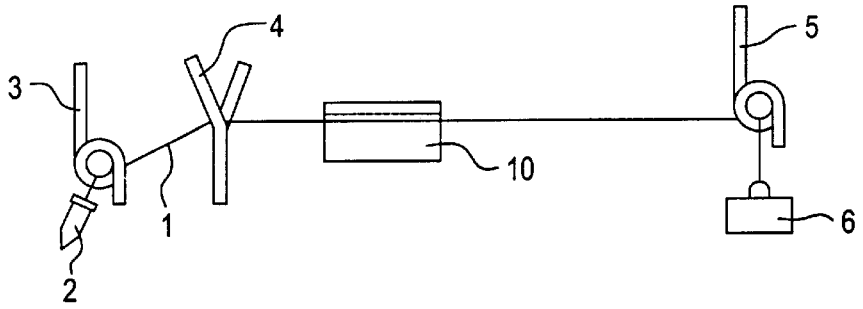
FIG. 1 shows a schematic of a set up used for measuring breaking time.

The reactive siloxanes are preferably employed in combination with cross-linking agents known per se but in particular with agents with low or no formaldehyde.

The reactive polysiloxanes are preferably side chain modified.

Preferably, fibers and yarns produced according to the NMMO process are treated.

It is particularly advantageous to employ the self cross-linking reactive polysiloxanes as an aqueous dispersion or as a solution with a concentration of 0.1 to 5% calculated as reactive polysiloxane. Solutions of the siloxanes can be present as aqueous, alcoholic or aqueous/alcoholic solutions; the solutions could also be produced using other solvents such as toluene, acetone and the like.

Aqueous microemulsions are particularly suited as aqueous dispersions. Microemulsions are especially fine-particled emulsions, where the particle size of the distributed particles of the liquid is mainly in the nanometer range, e.g. about 40 nm.

The emulsions can contain common ionic or nonionic emulsifiers.

The treatment of the invention is preferably carried out at a temperature ranging from 180 to 250C., whereby treatment times from 0.5 seconds to 5 minutes, in particular 10 seconds to 20 seconds, are preferred. Treatment on a hot contact plate is especially advantageous.

The process of the invention can be advantageously carried out continuously.

The fibers, threads, filaments, yarns and the like, which are not yet dried, can be treated in various ways with the reactive polysiloxanes under conditions in which essentially only a self cross-linking of the siloxane employed takes place. The fibers can be drawn through a bath consisting of the siloxane dispersion or siloxane solution. One further possibility to apply the reactive polysiloxane consists in, for example, the dispersion or the solution being sprayed on using appropriate apparatus. But an application using rollers is also possible, over which the fibers are guided so that they absorb the dissolved or dispersed siloxane. Corresponding rollers, which can have grooves, are known.

After the saturation, spraying, or application of the siloxane the fiber is for practical reasons guided through two rollers to squeeze away the excess solution or dispersion. The fiber is then guided into a zone in which an increased temperature dominates. Preferably this zone has a temperature of 180 to 250C. This treatment at the increased temperature includes a simultaneous drying of the fibers. In this temperature zone a cross-linking of the applied siloxane takes place, which essentially consists in a self cross-linking, i.e. cross-linking of the polysiloxane with the -OH groups of the cellulose does not take place or only to a lesser degree.

It is clear that the time in which the self cross-linking takes place depends on the temperature. In most cases, a treatment of 1 to 20 seconds at a temperature of 250° C. completely suffices to effect the self cross-linking.

In this way a very high productivity and operating speed is possible.

For the treatment at higher temperature, a common convection drier operated with hot air can be employed.

However other methods are likewise possible. The fibers or the yarn can be guided e.g. over a contact heating plate which is adjusted to a temperature of 250° C. for example. When contact heating plates are used the treatment duration is generally even shorter than is the case with a conventional convection drier. Times as low as 0.5 to 1 to 2 seconds suffice to effect the self cross-linking and to dry the fiber.

It is also possible to employ hot air in addition to a contact heating plate. One further possibility is to treat the fibers with rays, e.g. microwaves, UV light and the like.

EXAMPLES

The process of the invention can for instance be carried out as follows:

A slurry consisting of approx. 13% cellulose (80% Viskokraft ELV and 20% Viskokraft® VHV, commercially available cellulose products for example from International Pulp Sales Corp., New York, USA), and 87% aqueous NMMO solution with a water content of approx. 20% is continuously fed into an extruder, which contains a device to extract water.

Via a partial water separation a spinning solution with the following composition results: 14% cellulose, 11% water, 74.86% NMMO. The spinning solution additionally contains 0.14% gallic propyl ester as a stabilizer.

This spinning solution, which is maintained at a temperature of 1200° C., is pressed by means of a spinning pump through a spinning nozzle with 50 orifices, the individual orifice diameter measuring 130 $\mu$m, into an air gap. The air gap spans 18 cm. In the air gap, drawing by a factor of 15.9 takes place; subsequently the filaments are coagulated in an aqueous coagulation bath.

The filaments are pulled out of the coagulation bath and fed into a washing zone, in which the remaining NMMO is washed off the filaments. After leaving the washing zone some of the water is stripped away; additionally the fiber is blown upon with an air jet at room temperature so that the fiber still has a residual water content of approx. 300%. An aqueous dispersion of the active siloxane is applied by means of a rotating galette. After passage through a squeezing roller the fiber is guided through a convection drier exhibiting a temperature of 250° C. The retention time of the fiber in the drier is 10 seconds.

After leaving the drier the fiber is adjusted to a moisture content of 11% by using a nozzle. At the same time, a common finishing agent is applied by this process.

The aforementioned test was operated with different cross-linking concentrations in the bath. A yarn of 50 filaments and a total titer of 75 dtex was employed in each case. An aqueous microemulsion, which is commercially available as CT 96 E from Wacker-Chemie GmbH, Munich, Germany, was used to apply the cross-linking agent.

TABLE 1

| Yarn 75f50 | Cross-linking agent concentration/bath CT 96 E [percent by weight] | Breaking times [min.] | Elongation [%] | Strength [cN/tex] | Modulus 0.5–0.7% [cN/tex] | Dye receptivity [L] |
|---|---|---|---|---|---|---|
| Blind test | — | 0.9 | 7.0 | 32.1 | 1486 | 47.6 |
| Test no. | | | | | | |
| 1 | 0.10 | 1.8 | 8.5 | 32.6 | 1496 | 47.1 |
| 2 | 0.25 | 2.1 | 8.3 | 32.4 | 1580 | 43.6 |
| 3 | 0.30 | 2.3 | 8.1 | 33.3 | 1567 | 46.5 |

TABLE 1-continued

| Yarn 75f50 | Cross-linking agent concentration/bath CT 96 E [percent by weight] | Breaking times [min.] | Elongation [%] | Strength [cN/tex] | Modulus 0.5–0.7% [cN/tex] | Dye receptivity [L] |
|---|---|---|---|---|---|---|
| 4 | 0.50 | 3.1 | 9.0 | 33.7 | 1615 | 44.5 |
| 5 | 1.00 | 6.5 | 8.8 | 33.5 | 1558 | 44.1 |
| 6 | 1.50 | 7.5 | 9.0 | 33.4 | 1515 | 43.9 |
| 7 | 2.00 | >15.0 | 8.6 | 33.2 | 1563 | 43.7 |
| 8 | 2.50 | >15.0 | 8.5 | 31.8 | 1479 | 46.4 |

Surface cross-linking on wet yarns with CT 96 E at 250° C. for 10 seconds and resulting textile data and dye receptivity.

TABLE II

| Yarn 75f50 | Cross-linking agent concentration/bath CT 96 E [percent by weight] | Breaking times [min.] | Elongation [%] | Strength [cN/tex] | Modulus 0.5–0.7% [cN/tex] | Dye receptivity [L] |
|---|---|---|---|---|---|---|
| Blind test Test no. | — | 0.7 | 5.6 | 33.5 | 1188 | 50.4 |
| 9 | 0.20 | 0.8 | 4.6 | 32.1 | 1313 | 51.2 |
| 10 | 0.5 | 0.7 | 4.7 | 32.2 | 1319 | 40.5 |
| 11 | 1.0 | 0.9 | 4.8 | 32.0 | 1380 | 49.6 |
| 12 | 1.5 | 2.1 | 4.6 | 31.6 | 1421 | 50.3 |
| 13 | 2.5 | 3.2 | 5.4 | 31.5 | 1337 | 49.8 |

Surface cross-linking on dry yarns with CT 96 E at 250° C. for 10 seconds and resulting textile data and dye receptivity.

The values summarized in table 1 show that a self cross-linking on the wet yarn, which means the yarn which has not been dried and therefore still exhibits the primary swelling, has an excellent elongation, i.e. the elongation is reduced. The dye receptivity is excellent. In particular the breaking times are very high and are at least doubled compared to the breaking times of an untreated filament, and a very low concentration of the cross-linking agent in the bath is sufficient. With a concentration of 2% cross-linking agent in the cross-linking bath the breaking time of 0.9 minutes is increased to more than 15 minutes, i.e. by more than an order of magnitude.

In regards to dye receptivity the number L is used and was measured as follows:

Dye Receptivity:

Dyeing of the fiber was carried out according to the following formulation:

I. Preparation:

a. Precleaning: 2 ml/l Elvapur N 90 (obtainable from Akzo Nobel Chemicals, Düren, Germany), 1 g/l calc. soda, treatment for 20 minutes at 60° C.

b. Rinsing: Cold Permutit water

II. Dyeing: Dye Bath Ratio 1:30 (Permutit water)

0.5 g/l Solophenyl Blue GL (obtainable from Ciba-Geigy, Basel, Switzerland), 250% in relation to the fabric weight, 5 g/l calc. Glauber's salt.

The well dissolved colorant is added to the 60° C. dye bath and the fabric is dyed for 15 minutes at constant temperature. Then 5 g/l Glauber's salt (dissolved with boiling water) is added in 3 portions within 5 minutes and the dyeing continues for 15 additional minutes at a constant temperature. The total dyeing time is 35 minutes.

III. Aftertreatment:

a. Rinsing: Rinse thoroughly with well water.

b. Drying: Stretch out the fabric on a drying frame and dry it at room temperature.

The dye receptivity of the fabric was measured using Minolta chroma meters Cr-300, Cr-310 and Cr-331.

The value L is a measure for the brightness of the dyed product. The smaller the value, the better the dye receptivity is.

Table 2 states the values which were obtained on a yarn essentially the same as in table 1 with the difference that the treated yarns had been dried prior to the treatment, i.e. they no longer exhibited a primary swelling. In lower concentrations the breaking times are almost unchanged compared to the untreated yarn. Only in the higher concentrations can an improvement be noted, but it can in no way compare with the improvement obtained with yarns which were not yet dried.

A further subject of the invention is cellulose fibers and/or yarns with a reduced tendency to form fibrils, characterized in that the fibers or yarns possess a coating which is applied to fibers or yarns still exhibiting the primary swelling, a coating consisting essentially of self cross-linked and at least bifunctional reactive siloxanes. The coating amounts are preferably 0.1 to 1 per cent by weight in relation to the cellulose fibers or yarns. Additionally, the fibers are characterized in that they exhibit no or only a negligible reduction of elongation and dye receptivity. compared to untreated fibers or yarns. Moreover, they are characterized in that they show a breaking time which is at least twice as high as the breaking time of untreated fibers.

The fibers or yarns are preferably manufactured according to the NMMO filament production process.

The breaking time is a measure of the tendency of the fibers or yarns to form fibrils (see tables I and II). For measuring the breaking time, as depicted in FIG. 1, a bundle (1) made up of 50 filaments and secured at one end with a thread clamp (2) is guided through a thread guide (3). The bundle (1) is oriented with a Y piece (4) in relation to an ejector (10). The ejector (10) is followed by a thread guide (5) by which a deflection of the bundle (1) takes place, the bundle being weighted at its other end with a weight (6) of 20 grams. The distance between the first thread guide (3) and the Y piece (4), as well as between the Y piece (4) and the entrance of the ejector, is approx. 3 cm. The distance between ejector exit and the second thread guide (5) is approx. 11 cm. The ejector (10) is 22 mm long.

Figure 2:
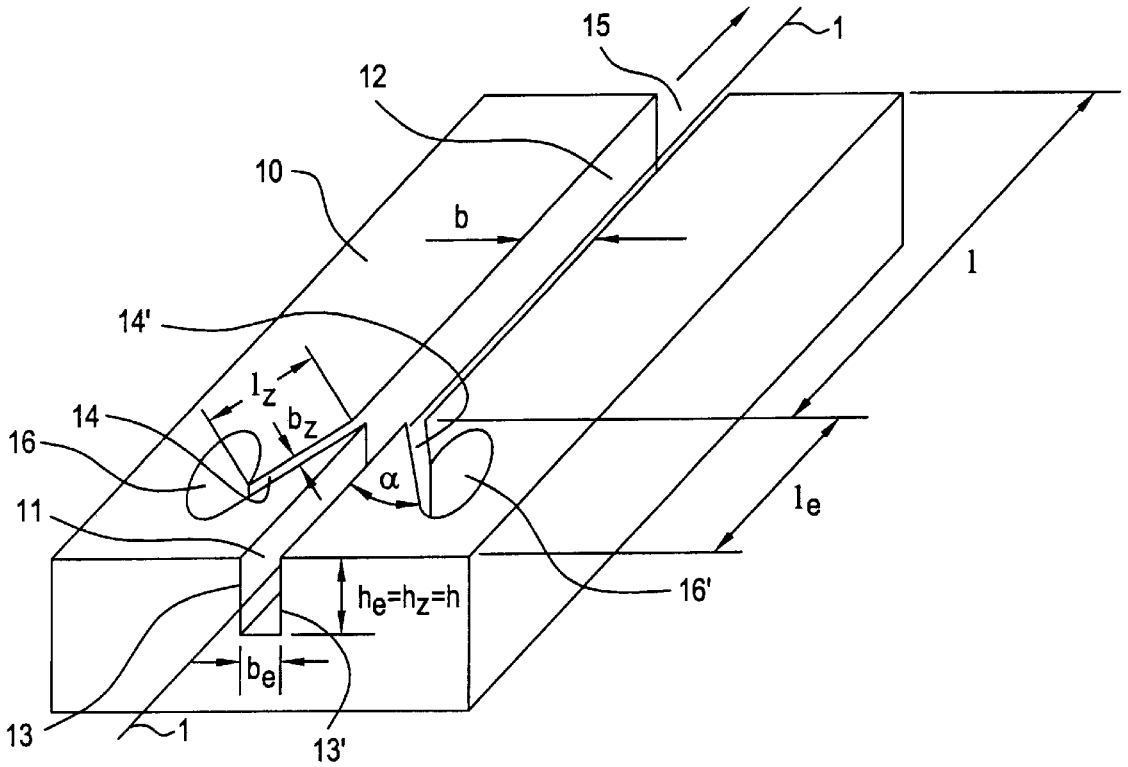
FIG. 2 is a perspective view of ejector 10 of FIG. 1.

According to the perspective depicted in FIG. 2, the ejector (10) exhibits an entrance slit (11) for bundle (1) with a square cross-section. The width $b_e$ and the height $h_e$ of the entrance slit (11) are 1 mm. The thread channel (12), which extends through the entire ejector (10), exhibits at a distance $l_e$ of 8 mm from the entrance slit (11) in both side walls (13 and 13') liquid feeding ducts (14 and 14') which are facing each other. Water at a temperature of approx. 25° C. streams through these feeding ducts (14 and 14') at an angle $\alpha$ of 15° relative to the axis of the bundle (1). The water flows at a rate totaling 45 1/h into the thread channel (12) and exits the ejector (10) at exit slit (15). The width $b_z$ of the liquid feeding ducts (14 and 14') is 0.6 mm and their height $h_z$ is 1 mm. The length $l_z$ of the feeding ducts (14 and 14') is 6 mm. The width of the thread channel (12) from the junction of the liquid feeding ducts (14 and 14') up to the exit slit (15) is 1.2 mm. The height h is 1 mm. Feeding with water takes place via bores (16 and 16') with a diameter of 4 mm from the underside of the ejector (10). The ejector (10) is closed off from above by a cover, not depicted, resting flatly on the ejector.

To determine the breaking time, the filament bundle (1) is inserted into the apparatus according to FIG. 1 and the weight is applied. The conduction of water into the ejector (10) represents the beginning of the time measurement. The time measurement ends when the weight falls, i.e. when the bundle tears. Ten individual measurements were carried out for each example, and the data stated for the breaking time represent the mean values of these 10 measurements. The higher this value, the lower the fibril formation.

Within the framework of the invention "functionally reactive" means that during the treatment of the fibers with the coating agent, whereby preferably an increased temperature is used, a cross-linking of the applied agent with itself takes place, somewhat similar to the reaction occurring during self condensation, and so that almost no cross-linking takes place with the cellulose, i.e. with the hydroxyl groups of the cellulose.

Since during this treatment a cross-linking with the cellulose is to be avoided, the self cross-linking can be carried out fundamentally in the absence of catalysts.

The possibility exists that e.g. during storage a subsequent cross-linking takes place. Sometimes this is even desired and can be promoted e.g. by adjusting the pH value and/or by catalysts. This subsequent cross-linking distinguishes itself however from a direct cross-linking, in which the various —OH groups of the cellulose molecules are cross-linked by bridges with each other, in that the network which has emerged through the self cross-linking is only linked to the cellulose at individual sites. By this process a wide-meshed, elastic network, so to speak, is formed which is only anchored to the cellulose at a few sites.

The self cross-linking is preferably carried out at pH values between 4 and 12.

Reactive polysiloxanes which can be used under the conditions of self cross-linking are described for example in Textilveredelung 20 (1985) No. 1, pages 8 to 12. This article describes the reactive siloxanes, which are modified with amino, polyalkylene oxide and epoxide functional groups and are exemplified using formulas which correspond to the FIGS. 7, 9 and 10. Polysiloxanes which are modified with a carboxyl functional group exhibit the carboxyl group as a side chain modification. Preferably the polysiloxanes are employed which are functionally modified on the side chain. The polysiloxane modification can be a simple side chain modification, i.e. they only exhibit functional groups of one specific type, but it is also possible to employ siloxanes which are twice modified, i.e. polysiloxanes which have different functional groups.

The end groups of the modified polysiloxanes are preferably hydroxyl, alkoxy and saturated alkyl groups, in particular the methyl group. Polysiloxanes with the vinyl group as an end group are less suited within the framework of the invention.

The functionally modified polysiloxanes employed in the invention are without exception commercially available. For example the brochure of Wacker Chemie GmbH, Munich, Germany, "Textil und Silikone, Weichmacher und Elastomere" (No. 4696.3/93(8)) 90, page 10 illustrates amino functional group silicones which could be employed for the invention. The brochure offers additional usable functional silicones. It also offers suitable microemulsions, e.g. the silicone microemulsion CT96E on page 14 of the brochure.

The functionally reactive polysiloxanes are preferably employed in the invention with further common cross-linking agents, in particular in combination with cross-linking agents which have low or no formaldehyde. Such cross-linking agents which are used in combination with the polysiloxanes are described in the following literature, to which reference is hereby explicitly made:

1. Stephen B. Sello
"Functional Finishes For Natural and Synthetic Fibres" Journal of Applied Polymer Science: Applied Polymer Symposium 31, 229–249 (1977)
2. Clark M. Welch
"Durable Press Finishing without Formaldehyde" Textile Chemist and Colorist, May 1990/Vol.22, No.5, pp. 13–16
3. Menachem Lewin and Stephen B. Sello
Handbook of Fiber Science and Technology: Volume II Chemical Processing of Fibers and Fabrics
4. H. Mark
Chemical Aftertreatment of Textiles John Wiley & Sons, Inc. 1971 ISBN 0-471-56989-5

In the cited article, in contrast to the usage according to the invention, the silicones serve for cross-linking of cellulose fibers which no longer exhibit primary swelling, i.e. have already been dried, e.g. to give the fibers a water-repellent finish.

The treatment under self cross-linking conditions is, however, carried out according to the invention on fibers, filaments and yarns between the washing zone, which follows the spinning bath, and the drier. This means that the treatment is carried out on fibers which are not yet dried.

Within the framework of the invention "fibers" is also understood to mean filaments, i.e. continuous fibers.

It was particularly surprising that, through the process of the invention, fibers, filaments and yarns are obtained which essentially exhibit their original elongation, possess an extraordinary dye receptivity and moreover achieve an unexpectedly high reduction of the tendency to form fibrils. The fibers can be further processed in the usual manner, i.e. wound up and processed to yarns of a wide variety of titers. Woven fabrics, warp knitted fabrics and other textile flat structures can be manufactured which stand out, compared to other products, in their reduced tendency to form fibrils. According to the process of the invention fibers, filaments and yarns can be manufactured from all common cellulose raw materials such as cotton linters, chemical wood pulp and the like. All patents and publications cited in this application are incorporated herein by reference in their entirety.

What is claimed is:

1. Cellulose fibers, filaments or yarns with a reduced tendency to form fibrils, comprising a coating which comprises reactive polysiloxanes which are modified with amino, polyalkylene oxide, epoxy or carboxyl functional groups and which are essentially self cross-linked, wherein said coating is applied while said cellulose fibers, filaments or yarns still exhibit a primary swelling.

2. Fibers, filaments or yarns according to claim 1, wherein said coating has a thickness of 0.1 to percent by weight in relation to the weight of the cellulose fibers, filaments or yarns.

3. Fibers, filaments or yarns according to claim 2, wherein a breaking time is at least twice as high compared to a breaking time of identical fibers, filaments or yarns which lack a coating of self cross-linked, at least bifunctional reactive siloxanes.

4. Cellulose fibers, filaments or yarns according to claim 3, wherein the fibers, filaments or yarns are produced according to the NMMO filament formation process.

5. Cellulose fibers, filaments or yarns according to claim 2, wherein the fibers, filaments or yarns are produced according to the NMMO filament formation process.

6. Fibers, filaments or yarns according to claim 1, wherein a breaking time is at least twice as high compared to a breaking time of identical fibers, filaments or yarns which lack a coating of self cross-linked, at least bifunctional reactive siloxanes.

7. Cellulose fibers, filaments or yarns according to claim 6, wherein the fibers, filaments or yarns are produced according to the NMMO filament formation process.

8. Cellulose fibers, filaments or yarns according to claim 1, wherein the fibers, filaments or yarns are produced according to the NMMO filament formation process.

* * * * *

UNITED STATES PATENT AND TRADEMARK OFFICE

CERTIFICATE OF CORRECTION

PATENT NO. : 6,180,234 B1
DATED : January 30, 2001
INVENTOR(S) : Abdulmajid Hashemzadeh It is certified that error appears in the above-identified patent and that said Letters Patent is hereby corrected as shown below:

Column 3,
Line 18, change "250C.," to -- 250°C., --; and
Line 41, change "250C." to -- 250°C. --.

Column 4,
Line 28, change "1200° C.," to -- 120°C., --.

Column 6,
Line 58, change "receptivity." to -- receptivity --.

Column 9,
Line 16, after "to" insert -- 1 --.

Signed and Sealed this

Twenty-ninth Day of January, 2002

*Attest:*

*Attesting Officer*

JAMES E. ROGAN
*Director of the United States Patent and Trademark Office*